United States Patent [19]

Chiba et al.

[11] 4,200,465

[45] Apr. 29, 1980

[54] ANTISTATIC LIGHT-SENSITIVE SILVER HALIDE PHOTOGRAPHIC ELEMENT

[75] Inventors: Norio Chiba; Hideyuki Anzai; Hisashi Yamaguchi; Koichi Horigome; Masao Ishihara; Sadatugu Terada, all of Hino, Japan

[73] Assignee: Konishiroku Photo Industry Co., Ltd., Tokyo, Japan

[21] Appl. No.: 934,332

[22] Filed: Aug. 16, 1978

Related U.S. Application Data

[63] Continuation of Ser. No. 795,294, May 9, 1977, abandoned, which is a continuation of Ser. No. 630,646, Nov. 10, 1975, abandoned.

[30] Foreign Application Priority Data

Nov. 12, 1974 [JP] Japan ..... 49/130772

[51] Int. Cl.[2] ..... G03C 1/78; G03C 1/96

[52] U.S. Cl. ..... 430/527; 430/510; 430/531

[58] Field of Search ..... 96/87 A, 67, 87 R, 84 R; 260/51 EP, 59 EP

[56] References Cited

U.S. PATENT DOCUMENTS

| | | | |
|---|---|---|---|
| 2,058,706 | 6/1937 | Schoeller et al. | 260/124 |
| 3,477,990 | 11/1969 | Dante et al. | 260/51 EP |
| 3,538,040 | 11/1970 | Grazen | 260/51 EP |
| 3,850,641 | 11/1974 | Horigorm et al. | 96/87 A |
| 3,951,662 | 4/1976 | Chiba et al. | 96/87 A |

FOREIGN PATENT DOCUMENTS 415718 9/1934 United Kingdom .

*Primary Examiner*—Jack P. Brammer

*Attorney, Agent, or Firm*—Haseltine, Lake & Waters

[57] ABSTRACT

An antistatic light-sensitive silver halide photographic element having an addition copolymer of glycidol and ethylene oxide with a phenol-aldehyde condensate as the antistatic agent, is described.

4 Claims, No Drawings

ANTISTATIC LIGHT-SENSITIVE SILVER HALIDE PHOTOGRAPHIC ELEMENT

This is a Rule 60 Continuation application of U.S. Ser. No. 795,294, filed May 9, 1977, now abandoned, which, in turn, is a Rule 60 Continuation of U.S. Ser. No. 630,646, filed Nov. 10, 1975, now abandoned.

This invention relates to a process for the antistatic treatment of light-sensitive silver halide photographic materials.

When light-sensitive silver halide photographic materials are charged with static electricity during preparation or use thereof, so-called static marks are undesirably formed at the time when the static electricity is discharged. Light-sensitive silver halide photographic materials undergo abrasion with or peeling off from other substances in the steps for preparation thereof such as, for example, rolling-up, rolling-back, coating and transportation at the time of drying, etc., with the result that the photographic materials are charged with static electricity. When the thus charged static electricity is discharged, the photographic materials coated with photo-sensitive layers are partly exposed, and when the thus exposed photographic materials are developed, there is brought about such drawback as the formation of so-called static marks derived from unevenly exposed portions. Further, also in the case where finished photographic materials are statically charged and are put into practical use particularly under low humidity conditions, there are brought about such various drawbacks that static marks are formed or dust adheres onto the surfaces of the photographic materials.

Heretofore, various antistatic agents have been used in photographic films in order to remove the above-mentioned drawbacks. Most of these antistatic agents, however, are not only unsatisfactory particularly under low humidity conditions, and do not display sufficient effects unless they are used at high concentrations. Further, when used in large quantities, most of the conventional antistatic agents give adverse effects on the sensitivity, fog and storability of light-sensitive silver halide photographic materials, or accompany adhesion trouble or bleeding problem. Thus, the conventional antistatic agents have not always been satisfactory in practice.

An object of the present invention is to provide an antistatic agent which is free from the aforesaid disadvantages.

Another object of the invention is to provide a process for successfully making a light-sensitive silver halide photographic material antistatic by use of said antistatic agent.

We have found that the above-mentioned objects can be accomplished by using as the antistatic agent a product obtained by addition-copolymerizing glycidol and ethylene oxide with a phenol-aldehyde condensate (the said product will be referred to as "the addition polymer of the present invention", hereinafter). That is, when the said antistatic agent is incorporated into at least one of silver halide emulsion layer, sub layer, inter layer, filter layer, antihalation layer, protective layer, backing layer and the like constitutive layers of a light-sensitive silver halide photographic material, or is coated on the upper-most layer or support of such photographic material, a desirable antistatic property can be imparted to the photographic material without deteriorating the sensitivity, gradation, fog, storability and the like photographic properties of the photographic material.

The phenol-aldehyde condensate, which is used as a starting material for production of the addition polymer of the present invention, is typically a substituted or unsubstituted phenol-aldehyde condensate having such recurring structural unit as represented by the general formula (I),

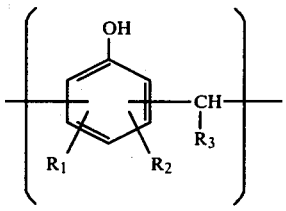

(I)

wherein $R_1$ and $R_2$ are individually hydrogen or halogen or carboxyl, acyl, alkoxycarbonyl, alkyl, substituted alkyl, alkoxy or phenyl, and $R_3$ is hydrogen or methyl or α-furyl.

Examples of such substituted or unsubstituted phenol-aldehyde condensate are as follows:

Phenol-formaldehyde resin
4-Methylphenol-formaldehyde resin
2-tert-Butylphenol-formaldehyde resin
4-tert-Butylphenol-formaldehyde resin
4-Octylphenol-formaldehyde resin
4-Nonylphenol-formaldehyde resin
2,4-Di-nonylphenol-formaldehyde resin
4-Dodecylphenol-formaldehyde resin
4-Tetradecylphenol-formaldehyde resin
2-Octadecylphenol-formaldehyde resin
4-Octadecylphenol-formaldehyde resin
3-Pentadecylphenol-formaldehyde resin
2,4-Di-tert-butylphenol-formaldehyde resin
2-Methyl-4-tetradecylphenol-formaldehyde resin
2-Chlorophenol-formaldehyde resin
4-Bromophenol-formaldehyde resin
3-Nitrophenol-formaldehyde resin
4-Carboxyphenol-formaldehyde resin
2-Chloro-4-hydroxyethylphenol-formaldehyde resin
2-Chloro-4-chloroethylphenol-formaldehyde resin
2-Iodoethyl-4-methoxycarbonylphenol-formaldehyde resin
4-Methoxyphenol-formaldehyde resin
4-Methylcarboxyphenol-formaldehyde resin
2-Hydroxymethyl-3-methylphenol-formaldehyde resin
4-Nonylphenol/2,4-di-nonylphenol-formaldehyde resin
Phenol-acetaldehyde resin
4-Methylphenol-acetaldehyde resin
4-tert-Butylphenol-acetaldehyde resin
2-Octylphenol-acetaldehyde resin
4-Nonylphenol-acetaldehyde resin
3-Pentadecylphenol-acetaldehyde resin
2,4-Di-tert-butylphenol-acetaldehyde resin
2-Methyl-4-tetradecylphenol-acetaldehyde resin
4-Chlorophenol-acetaldehyde resin
2-Bromophenol-acetaldehyde resin
2-Chloroethyl-4-chlorophenol-acetaldehyde resin
2-Iodomethyl-4-methoxycarbonylphenol-acetaldehyde resin
2-Methylcarboxyphenol-acetaldehyde resin
4-Nonylphenol/2,4-di-nonylphenol-acetaldehyde resin
4-Tetradecylphenol-acetaldehyde resin
2-Octadecylphenol-acetaldehyde resin 4-Octadecylphenol-acetaldehyde resin
4-Methoxyphenol-acetaldehyde resin
4-tert-Butylphenol-furfural resin
2,4-Di-nonylphenol-furfural resin
4-Dodecylphenol-furfural resin
4-Carboxyphenol-furfural resin
2-Chloro-4-hydroxyethylphenol-furfural resin
2-Hydroxymethyl-3-methylphenol-furfural resin
4-Nonylphenol/2,4-di-nonylphenol-furfural resin These phenol-aldehyde resins are obtained by the condensation reaction of phenols with aldehydes, in general. These resins having the same recurring structural units may also be prepared by condensing phenols with acetylene in place of acetaldehyde as starting material. Regardless of the manner of preparation, all the resins can effectively be used as starting materials for addition copolymerization with glycidol and ethylene oxide.

The phenol-aldehyde condensate used as a starting material for production of the addition polymer of the present invention further includes such product that a substituted or unsubstituted phenol-formaldehyde condensate having such recurring structural units as represented by the general formula (II),

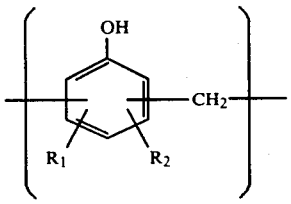

wherein $R_1$ and $R_2$ are individually hydrogen or halogen or carboxyl, acyl, alkoxycarbonyl, alkyl, substituted alkyl, alkoxy or phenyl, is treated with hydrogen halide, thereby converting the methylol group remaining at the terminal of the condensate into methyl halide.

Examples of the product obtained by halogenating such substituted or unsubstituted phenol-formaldehyde condensate are as follows:

Brominated phenol-formaldehyde resin
Brominated 4-methylphenol-formaldehyde resin
Chlorinated 2-tert-butylphenol-formaldehyde resin
Chlorinated 4-tert-butylphenol-formaldehyde resin
Brominated 4-octylphenol-formaldehyde resin
Chlorinated 4-cumylphenol-formaldehyde resin
Brominated 4-nonylphenol-formaldehyde resin
Chlorinated 2,4-di-nonylphenol-formaldehyde resin
Chlorinated 4-tetradecylphenol-formaldehyde resin
Brominated 2-octadecylphenol-formaldehyde resin
Chlorinated 2,4-di-tert-butylphenol-formaldehyde resin
Brominated 2-methyl-4-tetradecylphenol-formaldehyde resin
Chlorinated 2-chlorophenol-formaldehyde resin
Brominated 4-bromophenol-formaldehyde resin
Chlorinated 2-chloro-4-hydroxyethylphenol-formaldehyde resin
Brominated 4-methoxyphenol-formaldehyde resin.

The addition polymer of the present invention is a product obtained by addition-copolymerizing glycidol and ethylene oxide with such phenol-aldehyde condensate as mentioned previously. The said glycidol and ethylene oxide react with the hydroxyl group of the phenol nucleus of said phenol-aldehyde condensate, and are introduced into the position of said hydroxyl group of the phenyl nucleus as such block-copolymerized group as represented by the general formula (III) or (IV).

$$-O(CH_2\underset{\underset{OH}{|}}{C}HOH_2O)_{x1}\ (CH_2CH_2O)_{x2}H \qquad \text{(III)}$$

$$-O(CH_2CH_2O)_{y1}\ (CH_2\underset{\underset{OH}{|}}{C}HCH_2O)_{y2}H \qquad \text{(V)}$$

wherein $x_1$, $x_2$, $y_1$ and $y_2$ are individually the polymerization degree.

Further, a product, into which glycidol and ethylene oxide have been introduced as a random-copolymerized group, is also included in the addition polymer of the present invention.

The addition polymer of the present invention may be provided in the manner described below.

One or two or more of the aforesaid phenol-aldehyde resins or halogenated phenol-formaldehyde resins are dissolved in an organic solvent such as toluene, xylene or dioxane. Into the resulting solution, glycidol is dropped over a period of about 5 hours with stirring at 130° to 140° C., and the resulting mixture is subjected to addition polymerization reaction in the presence of an alkaline catalyst such as potassium hydroxide. Thereafter, ethylene oxide is injected into the reaction product with stirring at 130° to 140° C., and the mixture is subjected to addition polymerization reaction. After completion of the reaction, the reaction product is neutralized with glacial acetic acid, and then the organic solvent is removed under reduced pressure to obtain a glycidol and ethylene oxide-addition copolymer. When the order of addition of glycidol and ethylene oxide is made reverse, there is obtained a reversed block copolymer. The thus obtained glycidol- and ethylene-oxide-addition copolymer is viscous or waxy, in general, and is soluble in water or an organic solvent such as methanol, ethanol, acetone, dioxane, methyl cellosolve or dimethylformamide.

The amounts of glycidol and ethylene oxide to be addition polymerized are preferably about 1 to 20 moles and about 5 to 100 moles, respectively, per recurring structural unit of the phenol-aldehyde condensate or a halogenation product of phenol-formaldehyde. If the amounts of glycidol and ethylene oxide are more than said upper limits, the light-sensitive silver halide photographic material treated with the addition polymer of the present invention is undesirably fogged or deteriorated in other properties.

Typical examples of the addition polymer of the present invention are as shown below.

COMPOUND 1

Glycidol- and ethylene oxide-addition copolymer of 4-tert-octylphenol-formaldehyde resin (5 moles of glycidol and 20 moles of ethylene oxide per structural unit of the resin).

COMPOUND 2

Glycidol- and ethylene oxide-addition copolymer of 4-butylphenol-formaldehyde resin (1 mole of glycidol and 8 moles of ethylene oxide per structural unit of the resin).

COMPOUND 3

Glycidol- and ethylene oxide-addition copolymer of 4-nonylphenol-formaldehyde resin (3 moles of glycidol and 15 moles of ethylene oxide per structural unit of the resin).

COMPOUND 4

Glycidol- and ethylene oxide-addition copolymer of 4-methylphenol-formaldehyde resin (5 moles of glycidol and 15 moles of ethylene oxide per structural unit of the resin).

COMPOUND 5

Glycidol- and ethylene oxide-addition copolymer of 4-nonylphenol/2,4-di-nonylphenol-formaldehyde resin (molar ratio 1/1) (20 moles of glycidol and 20 moles of ethylene oxide per structural unit of the resin).

COMPOUND 6

Glycidol- and ethylene oxide-addition copolymer of 4-tert-octylphenol-formaldehyde resin (3 moles of glycidol and 10 moles of ethylene oxide per structural unit of the resin).

COMPOUND 7

Glycidol- and ethylene oxide-addition copolymer of 2-chloro-4-nonylphenol-formaldehyde resin (5 moles of glycidol and 18 moles of ethylene oxide per structural unit of the resin).

COMPOUND 8

Glycidol- and ethylene oxide-addition copolymer of brominated 4-tert-butylphenol-formaldehyde resin (1 mole of glycidol and 7 moles of ethylene oxide per structural unit of the resin).

COMPOUND 9

Glycidol- and ethylene oxide-addition copolymer of 4-methoxyphenol-formaldehyde resin (15 moles of glycidol and 10 moles of ethylene oxide per structural unit of the resin).

COMPOUND 10

Glycidol- and ethylene oxide-addition copolymer of 4-methoxycarbonylphenol-furfural resin (5 moles of glycidol and 10 moles of ethylene oxide per structural unit of the resin).

COMPOUND 11

Glycidol- and ethylene oxide-addition copolymer of chlorinated 4-phenylphenol-formaldehyde resin (20 moles of glycidol and 5 moles of ethylene oxide per structural unit of the resin).

COMPOUND 12

Glycidol- and ethylene oxide-addition copolymer of 4-dodecylphenol-formaldehyde resin (10 moles of glycidol and 3 moles of ethylene oxide per structural unit of the resin).

COMPOUND 13

Glycidol- and ethylene oxide addition copolymer of 4-cumylphenol-formaldehyde resin (10 moles of glycidol and 30 moles of ethylene oxide per structural unit of the resin).

COMPOUND 14

Glycidol- and ethylene oxide-addition copolymer of 4-isopropylphenol-formaldehyde resin (7 moles of glycidol and 10 moles of ethylene oxide per structural unit of the resin).

COMPOUND 15

Glycidol- and ethylene oxide-addition copolymer of 3-nitrophenol-formaldehyde resin (20 moles of glycidol and 50 moles of ethylene oxide per structural unit of the resin).

COMPOUND 16

Glycidol- and ethylene oxide-addition copolymer of 4-n-octylphenol-formaldehyde resin (5 moles of glycidol and 10 moles of ethylene oxide per structural unit of the resin).

COMPOUND 17

Glycidol- and ethylene oxide-addition copolymer of 4-tert-butylphenol-formaldehyde resin (5 moles of glycidol and 5 moles of ethylene oxide per structural unit of the resin).

COMPOUND 18

Glycidol- and ethylene oxide-addition copolymer of 4-tert-octylphenol-formaldehyde resin (110 moles of glycidol and 30 moles of ethylene oxide per structural unit of the resin).

For incorporation of the addition polymer of the present invention into any of silver halide emulsion layer, subbing layer, intermediate layer, filter layer, antihalation layer, protective layer, backing layer and the like constitutive layer of a light-sensitive silver halide photographic material, there may be adopted such procedure that the said addition polymer, either as it is or in the form of a solution in one or more of water and such organic solvents as methanol, ethanol, acetone, dioxane and methyl cellosolve, is added to a coating liquid for forming the said layer. In case the addition polymer of the present invention is desired to be applied to the surface of the outer-most layer of a light-sensitive silver halide photographic material, there may be employed such procedure that a solution of the said addition polymer in any of the above-mentioned solvents is spray-coated on the surface of said layer, or the photographic material is immersed in said solution, followed by drying.

In applying the addition polymer of the present invention to a light-sensitive silver halide photographic material, the amount thereof varies depending on the kind of the addition polymer and on the portion to which the addition polymer is applied, but when the addition polymer of the present invention is made present in a proportion of about $5\times10^{-1}$ to $1\times10^{-5}$ mole per $m^2$ of the photographic material, it is possible to attain an effective antistatic effect. However, the amount of the addition polymer of the present invention is not limited to said range, and the optimum amount capable of attaining a suitable effect may optionally be selected.

As binders for light-sensitive silver halide photographic materials to which the present invention is applicable, there are used gelatin and various hydrophilic colloids. In this case, the gelatin includes not only gelatin alone but also gelatin derivatives, which include reaction products of gelatin with acid anhydrides, reaction products of gelatin with isocyanates, and reaction products of gelatin with compounds having active halogen atoms, such as those disclosed in, for example, U.S. Pat. No. 2,614,928. Examples of the said acid anhydrides are maleic anhydride, phthalic anhydride, benzoic anhydride, acetic anhydride, isatoic anhydride and succinic anhydride; examples of said isocyanates are phenyl isocyanate, p-bromophenyl isocyanate, p-chlorophenyl isocyanate, p-tolyl isocyanate, p-nitrophenyl isocyanate and naphthyl isocyanate; and examples of the compounds having active halogen atoms are benzenesulfonyl chloride, p-methoxybenzenesulfonyl chloride, p-phenoxybenzenesulfonyl chloride, p-bromobenzene-sulfonyl chloride, p-toluenesulfonyl chloride, m-nitrobenzenesulfonyl chloride, m-sulfobenzoyl dichloride, naphthalene-β-sulfonyl chloride, p-chlorobenzenesulfonyl chloride, 3-nitro-4-aminobenzenesulfonyl chloride, 2-carboxy-4-bromobenzenesulfonyl chloride, m-carboxybenzenesulfonyl chloride, 2-amino-5-methylbenzenesulfonyl chloride, phthalyl chloride, p-nitrobenzoyl chloride, benzoyl chloride and furoyl chloride.

As the hydrophilic colloids for preparation of light-sensitive silver halide photographic emulsions, there may if necessary be used, besides such gelatin derivatives and usual photographic gelatin as mentioned above, colloidal albumin, agar, gum arabic, dextran, alginic acid, cellulose derivatives, e.g. cellulose acetate hydrolyzed to an acetyl content of 19 to 26%, polyacrylamides, imidated polyacrylamides, casein, urethanecarboxylic acid group- or cyanoacetyl group-containing vinyl alcohol polymers, polyvinyl alcohols, polyvinyl pyrrolidones, hydrolyzed polyvinyl acetates, polymers obtained by the polymerization of proteins or saturated acylated proteins with monomers having vinyl groups, polyvinylpyridine, polyvinyl amines, polyaminoethyl methacrylates and polyethyleneimines. These hydrophilic colloids may be used also in case there are formed inter layers, protective layers, filter layers, backing layers or the like constitutive layers other than emulsion layers.

Light-sensitive silver halide photographic materials to which the present invention is applicable may be any of black-and-white, color and pseudo-color photographic materials, and include all photographic materials for use as general films, printing films, X-ray films, radiation films, etc. of the negative, positive and diffusion transfer types.

Silver halide emulsions used in the above-mentioned silver halide photographic materials may contain as photosensitive components all kinds of silver halides such as silver chloride, silver iodide, silver bromide, silver iodobromide, silver chlorobromide and silver chloroiodobromide. Further, the said emulsions may be subjected to various chemical sensitization such as noble metal sensitization using salts of such noble metals as ruthenium, rhodium, palladium, iridium, platinum and gold, e.g. ammonium chloropalladate, potassium chloroplatinate, potassium chloropalladite and potassium chloroaurate, sulfur sensitization using sulfur compounds, reduction sensitization using stannous salts or polyamines, and sensitization using polyalkylene oxide type compounds, or may be subjected to optical sensitization using cyanine dyes, merocyanine dyes, complex cyanine dyes, etc. The emulsions may further be incorporated with various couplers such as colorless couplers, colored couplers, development inhibitor-yielding couplers, etc.; stabilizers such as triazole type compounds, azaindene type compounds, benzothiazolium type compounds, zinc compounds, etc.; film hardeners such as mucohalogenoacids, vinyl sulfone compounds, etc.; film property improvers composed of water-dispersible particulate polymeric substances obtained by emulsion polymerization, such as copolymers of alkyl acrylates or alkyl methacrylates with acrylic or methacrylic acid, styrene-maleic acid copolymers, styrene-maleic anhydride half alkyl ester copolymers, etc.; coating aids such as saponin, polyethylene glycol lauryl ether, etc.; wetting agents composed of such compounds as disclosed in, for example, U.S. Pat. No. 2,960,404, and Japanese Patent Publication Nos. 5316/1972 and 4939/1968, e.g. glycerin, diglycerin, ethylene glycol, diethylene glycol, triethylene glycol, tetraethylene glycol, 2,4,7,9-tetramethyl-5-decyne-4,7-diol, 3,6-dimethyl-4-octyne-3,6-diol, propylene glycol, hexylene glycol, pentanediol, 1,4-cyclohexanediol, 1,4-cyclohexanedimethanol, 1,3-cyclohexanediol, 1,2-cyclohexanedimethanol, 1-methyl-3,4-cyclohexanediol, 4-hydroxycyclohexanemethanol, trimethylolethane, trimethylolpropane, etc.; and the like various photographic additives.

The addition polymer of the present invention is an excellent antistatic agent, and displays a prominent antistatic effect when used singly. However, the same prominent effect is observed also in the case where the addition polymer of the present invention is used in combination with other antistatic agents. Among the conventional antistatic agents, there are some which are excellent in antistatic efficiency but have such disadvantage as to cause a bleeding phenomenon on the surface of light-sensitive silver halide photographic material. When such antistatic agent is used in combination with the addition polymer of the present invention, a desired antistatic effect can be attained by use of said antistatic agent in such an amount as to cause no bleeding phenomenon. Thus, the addition polymer of the present invention has such advantages that even other antistatic agents, which have heretofore been considered difficultly usable, is made effectively usable when used in combination therewith. Typical examples of other antistatic agents preferable for use in combination with the addition polymer of the present invention are compounds of the general formula (V),

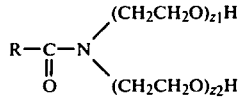

(V)

wherein R is an alkyl group having 1 to 20 carbon atoms, $z_1$ and $z_2$ represent individually the polymerization degree, and $z_1+z_2$ is 1 to 50.

The N-polyoxyethylene alkylamides of the general formula (V) are excellent antistatic agents, but have such disadvantages that they are not only insufficient in antistatic efficiency under extremely low relative humidity conditions but also caused a bleeding phenomenon when used in large quantities. When used in combination with the addition polymer of the present invention, however, it becomes possible to use the said compounds effectively without causing said disadvantages. As commercially available products of the compounds represented by the general formula (V), there are Amizet 5C Amizet 10C (produced by Nikko Chemical Co.). When combinations of the said compounds with the addition polymers of the present invention are applied to light-sensitive silver halide photographic materials, excellent antistatic effects can be displayed without any adverse effects on the photographic properties such as sensitivity and fog, storability and physical properties of the photographic materials.

As the supports for light-sensitive silver halide photographic materials to which the present invention is applied, there may be used optional supports such as films composed of polyethylene terephthalate, polycarbonate, polystyrene, polypropylene or cellulose acetate, baryta papers, polyethylene laminate papers, etc.

The present invention is illustrated below with reference to examples, but the modes of practice of the invention are not limited to the examples.

EXAMPLE 1

A high speed gelatin silver iodobromide emulsion containing 2.0 mole% of silver iodide was subjected to gold sensitization at the time of second ripening, incorporated with an azaindene compound as a stabilizer, formaldehyde as a hardener and saponin as a coating aid, coated on a polyethylene terephthalate film and then dried to form a silver iodobromide emulsion layer on the film.

Separately, an aqueous gelatin solution containing formaldehyde as a hardener and saponin as a coating aid was prepared. This solution was divided into five portions, and four portions of the solution were individually incorporated with 5 g. per liter of the solution of each of the compounds (2), (3), (6) and (8) as antistatic agents. Thereafter, the five portions of the solution were individually coated as a protective layer onto the aforesaid silver iodobromide emulsion layer and then dried to prepare samples. These samples were moistened at 25° C. and 20% RH for 12 hours, and the unexposed samples were rubbed with rubber in a dark chamber under definite air conditions, and then subjected to ordinary development to observe the state of formation of static marks.

As the result, marked formation of static marks was observed in the sample that had not been incorporated with any compound as the antistatic agent, whereas no formation of static marks was observed in the four samples incorporated with the compounds as antistatic agents. Further, change in photographic properties due to incorporation of the compounds was not observed at all in the said four samples.

EXAMPLE 2

A high speed gelatin silver iodobromide emulsion containing 1.5 mole% of silver iodide was subjected to gold sensitization at the time of second ripening, incorporated with the same stabilizer, hardener and coating aid as in Example 1, coated on a polyethylene terephthalate film and then dried to form a silver iodobromide emulsion layer on the film. Subsequently, an aqueous gelatin solution containing mucochloric acid as a hardener and saponin as a coating aid was coated as a protective layer onto the aforesaid silver iodobromide emulsion layer and then dried to obtain a photographic film. The thus obtained film was divided into eight portions, and a methanol solution of each of the compounds (1), (4), (5), (8), (10), (12) and (14) as antistatic agents was coated on the protective layer of each of the seven portions of the photographic film so that the amount of each compound became 1.0 g. per $m^2$, and then dried to prepare samples. These samples were treated in the same manner as in Example 1 to observe the state of formation of static marks.

As the result, marked formation of static marks was observed in the sample having the protective layer not coated with any compound as the antistatic agent, whereas no formation of static marks was observed in the seven samples having the protective layers coated with the compounds as the antistatic agents. Further, change in photographic properties due to incorporation of the compounds was not observed at all in the said seven samples.

EXAMPLE 3

A high speed gelatin silver iodobromide emulsion containing 1.5 mole% of silver iodide was subjected to gold sensitization at the time of second ripening, incorporated with an azaindene compound as a stabilizer, glyoxal as a hardener and saponin as a coating aid, coated on a polyethylene terephthalate film and then dried to form a silver iodobromide emulsion layer on the film. Separately, an aqueous gelatin solution containing formalin as a hardener and saponin as a coating aid was prepared. This solution was divided into several portions, which were then incorporated individually with such combination as shown in Table 1 of the exemplified compound, i.e. the addition polymer of the present invention, with an N-polyoxyethylene alkylamide as other antistatic agent. Subsequently, the thus treated portions of the solution were individually coated on the aforesaid silver iodobromide emulsion layer and then dried to prepare samples. These samples were moistened at 25° C. and each of 10%, 15%, 20%, 30% and 40% RH for 12 hours, rubbed with rubber in a dark chamber under definite air conditions, and then subjected to ordinary development to observe the state of formation of static marks. The results obtained were as shown in Table 1.

Table 1

| Sample No. | N-Polyoxyethylene alkylamide* R | $z_1 + z_2$ | Amount (g/l) | Addition polymer of the invention Compound No. | Amount (g/l) | Humidity condition (%RH) | Formation of static marks |
|---|---|---|---|---|---|---|---|
| 1 | $C_8H_{17}$ | 10 | 1.0 | (16) | 2.0 | 10 | None |
| 2 | $C_8H_{17}$ | 10 | 1.0 | (16) | 2.0 | 20 | None |
| 3 | $C_8H_{17}$ | 10 | 1.0 | (16) | 2.0 | 30 | None |
| 4 | $C_8H_{17}$ | 10 | 1.0 | (16) | 2.0 | 40 | None |
| 5 | $C_{12}H_{25}$ | 5 | 1.0 | — | — | 20 | Great |
| 6 | $C_{12}H_{25}$ | 5 | 2.0 | — | — | 20 | Some |
| 7 | $C_{12}H_{25}$ | 5 | 1.0 | (17) | 1.0 | 20 | None |
| 8 | $C_4H_9$(t) | 15 | 1.5 | — | — | 15 | Some |
| 9 | $C_4H_9$(t) | 15 | 1.5 | (18) | 0.5 | 15 | Slight |
| 10 | $C_4H_9$(t) | 15 | 1.5 | (18) | 1.5 | 15 | None |
| 11 | — | — | — | — | — | 20 | Markedly great |

*A compound of the aforesaid general formula (V); the kind thereof is shown by merely showing R and $z_1 + z_2$.

What we claim is:

1. A light-sensitive silver halide photographic element, having an emulsion layer on a film support, wherein the element contains $5\times10^{-1}$ to $1\times10^{-5}$ mole per $m^2$ of a glycidol and ethylene oxide addition copolymer of a phenol-aldehyde condensate, in which the molar portion of glycidol and ethylene oxide are respectively 1 to 20 moles and 5 to 100 moles per structural unit of the phenol-aldehyde condensate and wherein the copolymer is present in a light-sensitive silver halide emulsion layer, a subbing layer, an intermediate layer, an antihalation layer, a filter layer, a protective layer or a backing layer, or on an outermost surface of the element.

2. A light-sensitive silver halide photographic material according to claim 1, wherein the copolymer is present in an outermost layer of the material or on the outermost surface.

3. A light-sensitive silver halide photographic material according to claim 2, wherein the copolymer is deposited on a surface of the outermost layer by spray-coating of water or an organic solution of the copolymer or immersion of the material in the solution.

4. A light-sensitive silver halide photographic material according to claim 1, wherein the material further comprises a compound of the following formula

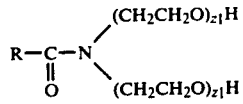

wherein R represents an alkyl group having 1 to 20 carbon atoms and $z_1$ and $z_2$ each represents a positive integer of 1 to 50 provided that $z_1+z_2$ is 1 to 50.

* * * * *